US012377938B1

(12) United States Patent
Wang et al.

(10) Patent No.: US 12,377,938 B1
(45) Date of Patent: Aug. 5, 2025

(54) ENVIRONMENTAL DATA COLLECTION OCEAN BUOY AND HURRICANE EYE TRACKING

(71) Applicants: James C. Wang, Las Vegas, NV (US); Jane Wojcik, Brookline, MA (US); Michael Wojcik, Brookline, MA (US); Y. S. Hsu, Rancho Palos Verdes, CA (US)

(72) Inventors: James C. Wang, Las Vegas, NV (US); Jane Wojcik, Brookline, MA (US); Michael Wojcik, Brookline, MA (US); Y. S. Hsu, Rancho Palos Verdes, CA (US)

( * ) Notice: Subject to any disclaimer, the term of this patent is extended or adjusted under 35 U.S.C. 154(b) by 0 days.

(21) Appl. No.: 19/083,190

(22) Filed: Mar. 18, 2025

(51) Int. Cl.
*B63B 22/20* (2006.01)
*B63B 79/15* (2020.01)

(52) U.S. Cl.
CPC ..... *B63B 22/20* (2013.01); *B63B 79/15* (2020.01)

(58) Field of Classification Search
CPC ..... B63B 22/20; B63B 79/15
See application file for complete search history.

(56) References Cited

U.S. PATENT DOCUMENTS

| | | | | |
|---|---|---|---|---|
| 10,569,839 | B1 * | 2/2020 | Thomson | B63B 22/12 |
| 10,640,177 | B1 * | 5/2020 | Robertson | B63B 22/18 |
| 2008/0311805 | A1 * | 12/2008 | Spears | B63B 22/22 441/30 |
| 2012/0037063 | A1 * | 2/2012 | Backes | E21B 43/0122 114/312 |
| 2015/0185007 | A1 * | 7/2015 | Deshetler Brinton | G01V 3/08 702/2 |
| 2015/0346726 | A1 * | 12/2015 | Davoodi | B63B 22/20 440/38 |
| 2018/0031733 | A1 * | 2/2018 | Ozgokmen | G01S 19/14 |
| 2022/0185436 | A1 * | 6/2022 | Kaneshika | B63C 9/065 |

* cited by examiner

*Primary Examiner* — S. Joseph Morano
*Assistant Examiner* — Jovon E Hayes
(74) *Attorney, Agent, or Firm* — SHUTTLEWORTH & INGERSOLL, PLC; Jason R. Sytsma

(57) ABSTRACT

A buoyancy control system, GPS sensor and data analysis engine, a wind direction sensor, and a controller to detect significant wind direction changes. Upon calculation that the desired location within the eye wall has been reached the buoy descends to depths where ocean currents are reduced, preventing drift from the hurricane eye. A solar sensor triggers ascent when sunlight indicates reentry into the eye.

20 Claims, 6 Drawing Sheets

ENVIRONMENTAL DATA COLLECTION OCEAN BUOY AND HURRICANE EYE TRACKING

TECHNICAL FIELD

This disclosure relates to a variably buoyant ocean buoy, and, more specifically, this disclosure relates to variably buoyant ocean buoy self-navigable around an eye of a hurricane for improved data collection.

BACKGROUND INFORMATION

Global warming has increased the frequency and intensity of hurricanes. Accurate tracking and forecasting of hurricane paths can provide communities with critical time to prepare, saving lives and minimizing damage.

FIG. 1 illustrates a typical hurricane. The center of a hurricane is known as the "eye," where weather is typically sunny and calm, although ocean waves are erratic and high. Surrounding the eye is the "eye wall," the most violent part of a hurricane. Wind speeds in the eye wall exceed 100 knots, while ocean currents under the eye wall surpass 30 knots. In the Northern Hemisphere, due to the Coriolis effect, wind and water currents in the eye wall move in a circular, counterclockwise direction around the eye. In the Southern Hemisphere, the Coriolis effect causes a clockwise rotation. FIG. 1*a* depicts a typical hurricane in the Northern Hemisphere. The eye moves in the direction of the arrow. Positions "B" (back of the eye), "F" (front of the eye), and "M" (midpoint of the eye) represent 90-degree increments around the eye wall.

Currently, hurricanes are tracked using four primary methods:

1. Airplanes flying through hurricanes to collect data during their flight.
2. Dropping "drifters" (traditional buoys with no directional control) into the hurricane from airplanes.
3. Stationary buoys tethered to the ocean floor, typically near the shore.
4. Satellite imagery.

These methods have significant limitations:

1. Hurricane Airplanes: Airplanes collect atmospheric data at high altitudes (between 150 m and 3,000 m) but do not provide sea-level atmospheric or oceanic data. Their data collection is limited by fuel constraints, as they can only remain in the hurricane for short periods. Moreover, these airplanes are expensive to build and operate, and the time required to travel to and from the hurricane reduces their effectiveness.
2. Drifters: Buoys dropped into hurricanes can collect oceanic and sea-level atmospheric data but cannot remain in the eye. High winds and fast currents push drifters away from the eye. As shown in FIG. 1*b*, wind and water forces act tangentially to the eye, gradually moving the buoy away in a spiral pattern, as depicted in FIG. 1*c*. Hurricane-hardened buoys are expensive, costing over $100,000 each, making them an inefficient option.
3. Stationary Buoys: These buoys are predominantly anchored near shorelines, limiting their utility for tracking hurricanes in open waters.
4. Satellite Imagery: While satellites are useful for identifying developing hurricanes and locating their centers, they lack the resolution to provide detailed sea surface or atmospheric data needed for precise tracking.

There is a need for a real-time data measurement and collection device capable of gathering sea-level data from the eye of a hurricane and navigating within the eye throughout the hurricane's lifecycle.

SUMMARY

This disclosure relates to a buoy designed to collect real-time atmospheric and oceanic data from a hurricane. The buoy is configured to float on the water surface and includes a buoyancy control system that allows it to dynamically adjust its depth based on environmental conditions. After the smart buoy (100) is dropped into the eye of the hurricane, the on-board computer uses photocell, GPS and hurricane data from the a hurricane tracking source, such as from a government source like the National Oceanic and Atmospheric Administration (NOAA) website to calculate the amount of time it will take the buoy cycle through the eye of the hurricane. When the travel time expires, and the buoy is at the front of hurricane eye wall, the buoyancy control system commands the buoy to descend to a depth where ocean currents are reduced, preventing it from drifting out of the hurricane's eye. When ambient light levels indicate that the buoy has returned to the eye, the buoyancy control system directs the buoy to ascend to the surface to resume data collection. The buoy system will continue this cyclic path around the hurricane eye for the duration of the hurricane. Alternatively, a wind direction sensor could continuously monitors wind patterns, and a controller could determine whether a significant change in wind direction has occurred. Upon detecting such a change, the buoyancy control system commands the buoy to descend.

The buoyancy control system may include an air compressor, an air cylinder, an adjustable float, and a bidirectional valve to regulate airflow between the air cylinder and the float. This system allows the buoy to selectively receive or release air, controlling its buoyancy as needed. Alternative implementations may employ other buoyancy control mechanisms to achieve similar functionality.

The buoy continuously monitors environmental data for any significant change in wind direction and any one of multiple criteria, including deviations from the expected rotational path of the hurricane, outward shifts relative to the storm center, angular changes over time, or a combination of wind speed, drift velocity, and direction changes within a specified timeframe. The buoy can descend to depths where ocean currents are significantly lower than at the surface, including depths where currents are reduced by at least fifty percent or at least eighty percent.

A solar sensor may be incorporated to detect sunlight, allowing the buoy to determine when it has re-entered the eye of the hurricane and trigger its ascent. Additionally, the buoy may include a motorized winch to deploy sea instruments, an extendable boom for weather instruments, a battery controller that conserves power by entering a low-power mode during minimal hurricane path changes, and a transmitter to relay collected data to a remote base station.

A method is also disclosed for maintaining the buoy within or near the hurricane eye, involving deployment into the storm, monitoring GPS determined location, wind direction and drift, adjusting buoyancy to descend or ascend based on predefined conditions, and transmitting environmental data. The method further details how the air compressor, air cylinder, adjustable float, and bidirectional valve work together to control buoyancy.

By continuously adjusting its position, the buoy provides high-resolution real-time data, enhancing the ability to track and predict hurricane behavior while minimizing the costs and limitations associated with existing tracking methods.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

This disclosure concerns methods for improving tracking and sea-level environmental data collection in the eye of a hurricane, from its formation until it weakens. Accurate data in the hurricane's eye is crucial for predicting its path and development. The water temperature in the eye—and the rate at which that temperature changes—significantly affects a hurricane's intensification or weakening. Also disclosed is a method for tracking a hurricane, from formation to dissipation, using a single buoy that remains in or near the eye throughout the hurricane's lifecycle. A battery-powered "smart" buoy is described that performs hurricane eye tracking and monitoring. Compared to prior methods, the approaches disclosed herein provide more reliable, more accurate hurricane eye data. Because this method uses only a single buoy, it is also dramatically less expensive than existing techniques.

Figure 1A:
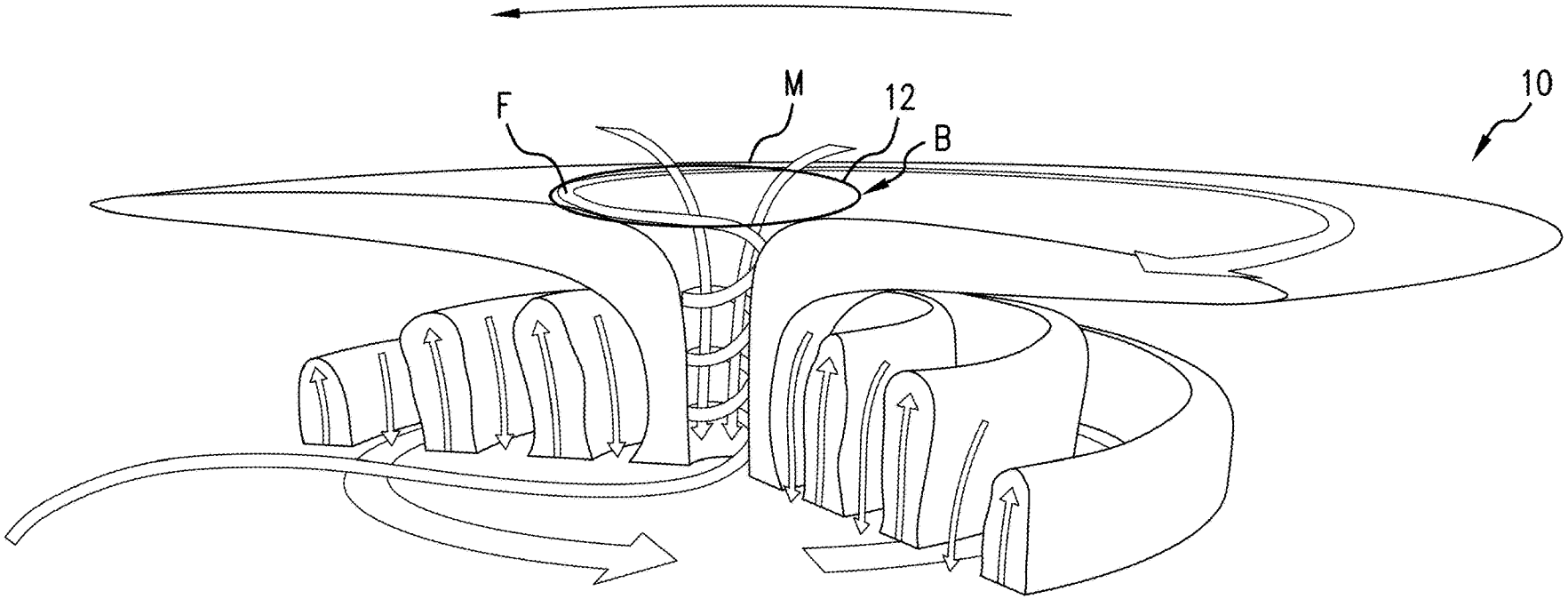
FIG. 1*a* is an illustration of a typical hurricane in the Northern Hemisphere.
Figure 1B:
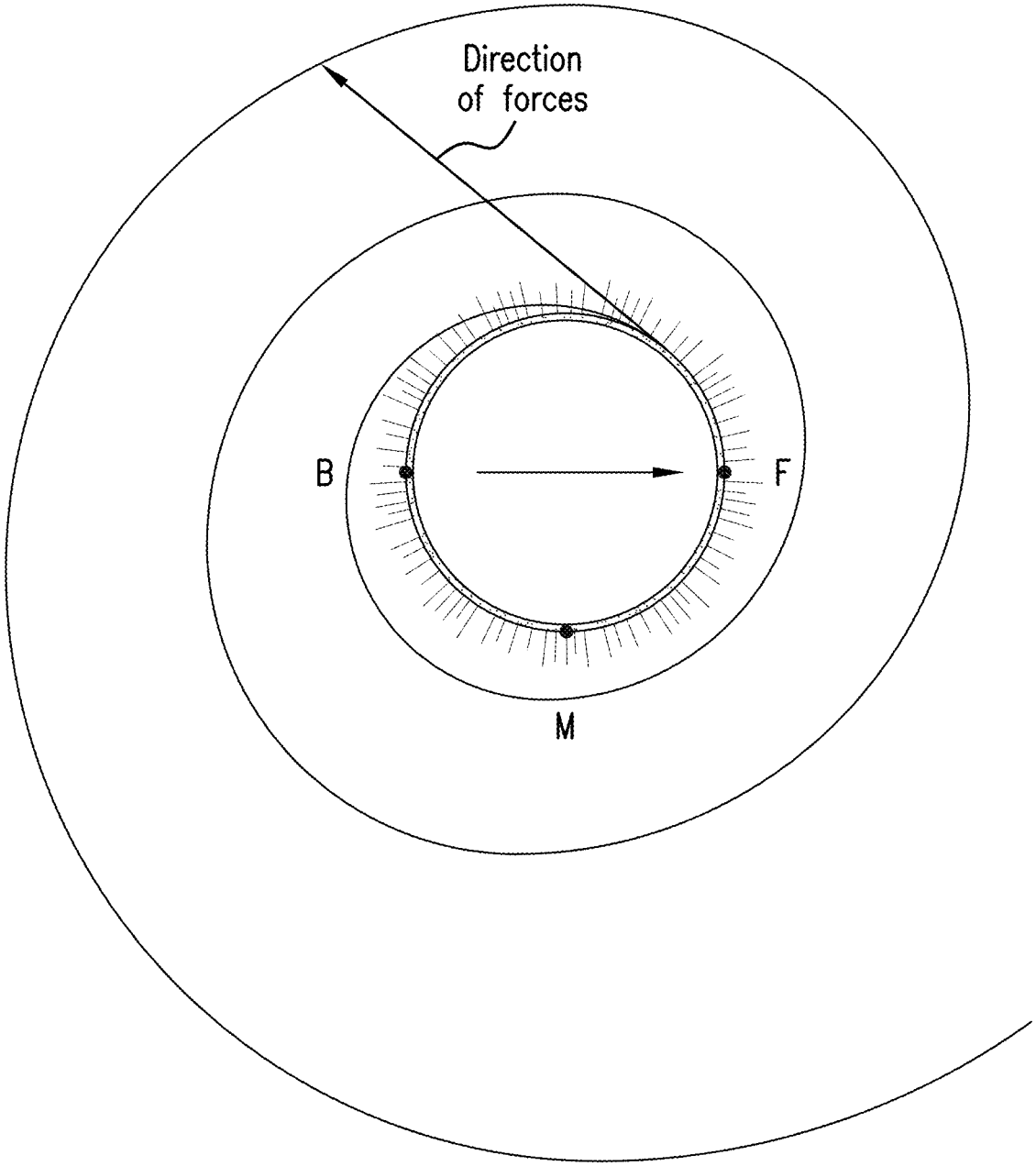
FIG. 1*b* is the direction of hurricane forces on a buoy.
Figure 1C:
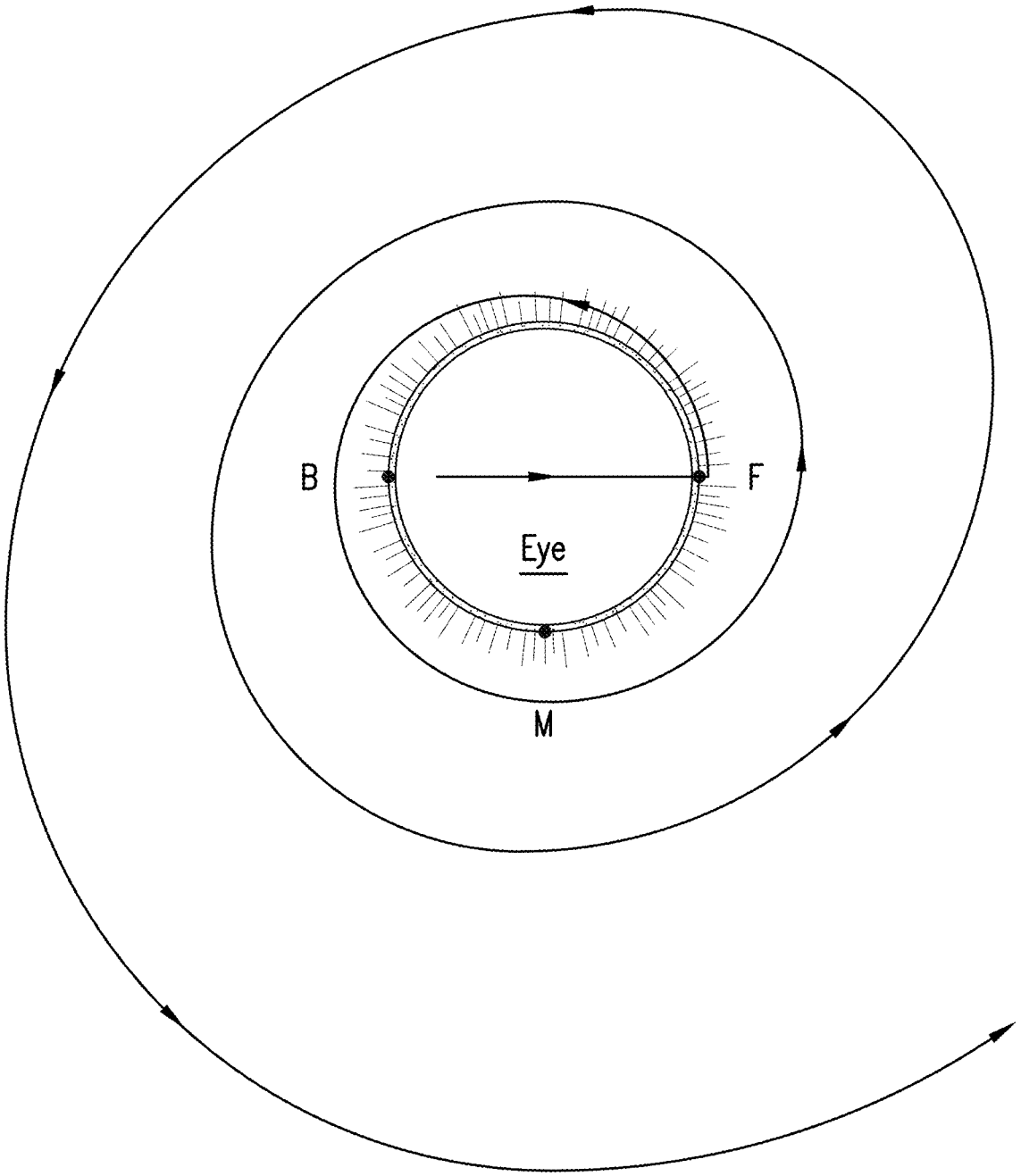
FIG. 1*c* is the travel path of a regular drifter in a hurricane.
Figure 1D:
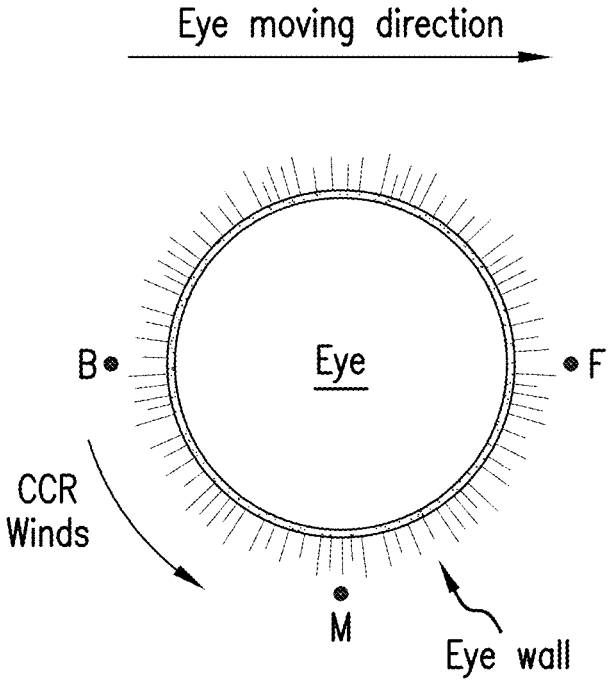
FIG. 1*d* is the travel path of a smart buoy 100.
Figure 3:
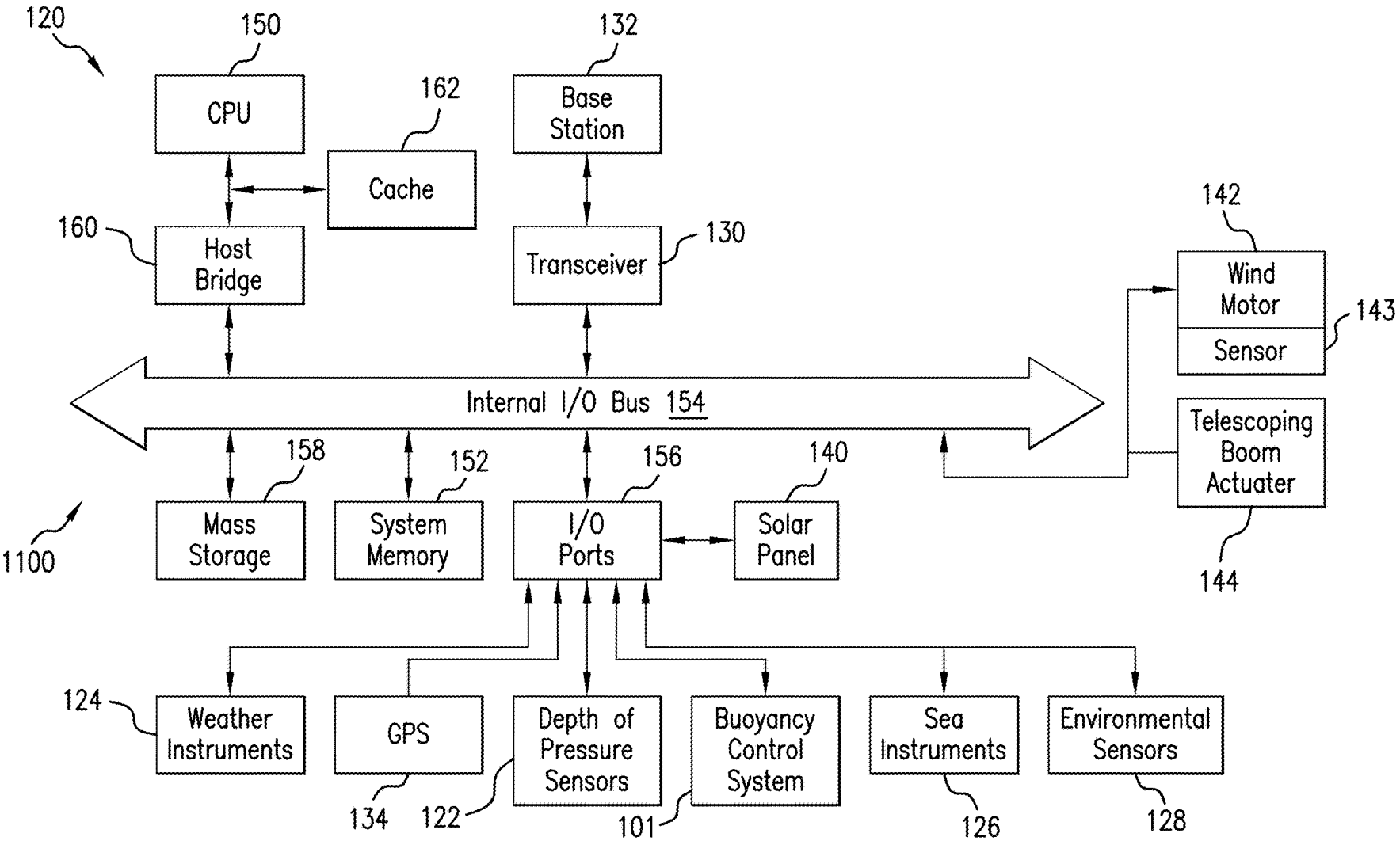
FIG. 3 is a schematic diagram of the computer system and control circuitry of this disclosure.

FIG. 3 shows a smart buoy 100 equipped with software and hardware enabling it to ascend and descend in seawater at will. Buoy 100 can be dropped directly into the hurricane's eye by an airplane. Through an innovative maneuvering process, buoy 100 remains in—or very near—the hurricane eye at all times. Referring to FIG. 1A, 1D, once buoy 100 is dropped into the eye, the eye wall eventually catches up to it, then moving buoy 100 across the eye wall from front to back, then in in a counterclockwise rotation around the eye: from the back of the eye wall ("B"), to the midpoint ("M"), and then to the front ("F"). As will be discussed below, buoy 100 descends until the hurricane's eye is overhead, then ascends back to the surface and repeats the cycle. In this manner, buoy 100 travels continuously from points F to B to M to F, for the duration of the hurricane's journey over the ocean. The buoy does not have to reach the exact center of the front eye wall to sink down. It can sink down anywhere within a 10 mile range of the front to start another cycle and still be considered substantially near the front of the eye wall.

Buoy 100 remains within the hurricane's eye wall because it can change its buoyancy and depth based on a programmed algorithm in its onboard computer. After buoy 100 is dropped into the eye, it stays on the surface and the onboard computer continues to monitor the environmental data. Buoy 100 takes advantage of the significantly reduced water current below the surface. At around 3 meters depth, the current decreases from approximately 30 knots to 10 knots representing slightly more than a fifty percent reduction from the surface current speed, which may vary based on storm intensity; at about 30 meters, it slows to under 5 knots or less, achieving a reduction of around eighty percent compared to the surface current. These depth-dependent reductions in current speed provide a stable environment for buoy 100 to remain within or near the hurricane's eye by selectively adjusting its buoyancy. As the hurricane eye continues to move, as shown in FIG. 1C, the back side of the hurricane reaches buoy 100 at point B. While buoy 100 remains on the surface, high winds and fast currents in the eye wall push buoy 100 from B to M to F—much like a drifter buoy. At point F (FIGS. 1A, 1D), it commands buoy 100 to descend about 30 meters, below the reach of strong winds and swift currents. There, buoy 100 essentially stops drifting. It remains submerged until its light sensor detects sunlight overhead, signaling that the hurricane's eye has again passed above. Buoy 100 then ascends, resurfaces inside the eye, and resumes monitoring. Eventually, point B of the eye catches up with buoy 100 again, and the cycle repeats until the hurricane makes landfall. See FIG. 1*d*.

In a first example of controller 100 determining when to initiate the descending protocol, buoy 100 is dropped just in front of the eye wall. Buoy 100 sinks below the fast moving current. Buoy 100, detecting sunlight in the eye, by a photocell 140, rises to the surface and begins collecting data. Buoy 100, using onboard computer 120 contacts the NOAA web site and receives back information that the eye wall is 20 miles in diameter, moving at 5 miles/hr with a current of 60 miles/hr. Therefore, in this example, controller 100 calculates given the diameter of the eye, it will take the buoy 100 four hours to traverse the eye (point F to point B) and thirty minutes to reach the front of the eye again (points B to M to F). After four hours and thirty minutes of data collection, buoy 100 sinks. When the photo cell 120 detects sunlight, buoy 100 ascends and repeats the cycle.

Controller 120 can use additional analytics to assure that it continues its cyclic path around the eye wall. Controller 120 is able to track the path of buoy 100 as it travels from points B to M to F by calculating the amount of time it moves to the front of the eye. In addition to GPS data, its location at the front of the eye (F) can be confirmed based on wind speed, wind direction and wind current data. The wind direction at point B is southerly. At point F, it is 180 degrees opposite, coming from a northerly direction. The water current direction will also change in a similar fashion.

Controller 120 can make the decision to descend, however, in various ways. In another embodiment, controller 120 can initiate the descending algorithm when it detects a significant change in wind direction. With reference back to FIGS. 1B, 1C shown is the direction of travel of the eye and the direction of forces on a buoy and an ever increasing diameter travel a buoy takes until it eventually is outside the hurricane's path of travel. Buoy 100 needs to stay in the path of travel, so buoy 100 needs to descend before it is ejected from the boundary area of the eye wall, which will begin to happen around point F. In this light, a significant change in wind direction can include: (i) when the wind direction deviates from the expected rotational path of the hurricane eye within a period of time, which deviation could be between 1° to 30° (or any angle in between) over a period of 1 second to 60 seconds, inclusive (or any number of seconds in between); or (ii) when the wind direction shifts outward relative to the hurricane's center within a period of time, which outward shift could be between 1° to 30°, inclusive (or any angle in between), over a period of 1 second to 60 seconds, inclusive (or any number of seconds in between); (iii) when a wind direction rate of change exceeds an angular change per unit of time, e.g., 1° to 30°, inclusive (or any angle in between), per second or some number of seconds; (iv) outward drift speed of buoy 100 exceeds 0.5-2 knots, inclusive (or any speed in between) with a wind speed exceeding 10-50 knots, inclusive (or any speed in between) and wind direction changes 1° to 30°, inclusive (or any angle in between) within a period of 1 second to 60 seconds, inclusive (or any number of seconds in between); or (v) some combination of the foregoing.

When buoy 100 is on the ocean surface inside the hurricane eye, it can deploy atmospheric instruments to measure air pressure, temperature, and similar parameters. Buoy 100 can also deploy sensors to collect seawater temperature, salinity, and other data. Additionally, buoy 100 may use GPS to determine its location and to receive updates on hurricane path and intensity via satellite communication. Monitoring data is sent through satellite communication to designated servers on the Internet at a base station. Multiple buoys 100 can be deployed to improve coverage and data collection.

Figure 2:
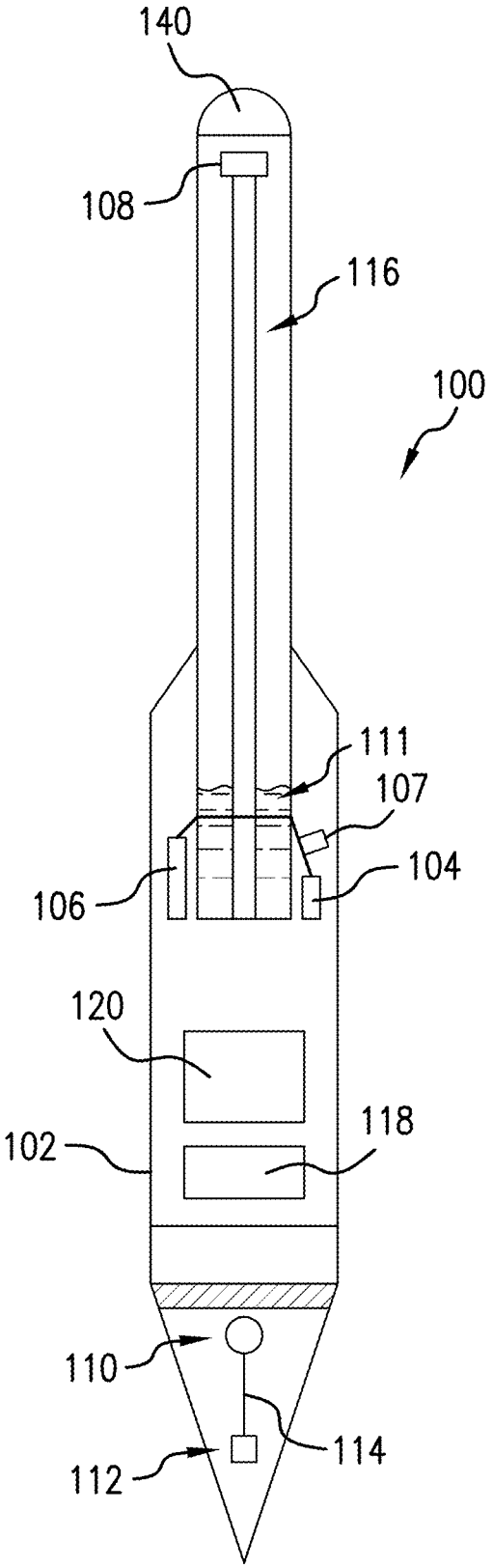
FIG. 2 is a schematic diagram of a buoy according to this disclosure.

More specifically, as shown in FIG. 2, buoy 100 comprises a water-tight sealed housing 102 enclosing a buoyancy control system 101 (see FIG. 3), comprising an air compressor 104, an air cylinder 106, an adjustable float 108, and a bidirectional valve 107 to exchange air between air cylinder 106 and adjustable float 108. Sealed shell of housing 102 protects the internal electronics and mechanical components from seawater and external pressure.

Adjustable float 108 is a variable-volume bladder or chamber that can be selectively filled with air or purged of air, thereby altering overall buoyancy of buoy 100. Inflating the float increases the volume of the float without changing the mass, thereby lowering density and causing adjustable float 108 to rise. Pumping air out of adjustable float 108 back into air cylinder 106 will increase the density of adjustable float 108, allowing it to sink to a specified depth When buoyancy needs to be increased, air compressor 104 draws air from air cylinder 106 and pumps it into adjustable float 108, via an air line with a bidirectional valve 107 attached to adjustable float 108. Conversely, when buoyancy needs to be reduced, air in adjustable float 108 is returned to air cylinder 106, causing adjustable float 108 to sink to the desired depth.

To descend, the onboard controller 120 first commands the air compressor 104 to evacuate or reduce air within adjustable float 108 (returning air to air cylinder 106 via the bidirectional valve 107), decreasing internal buoyancy. Depth or pressure sensors 122, shown in FIG. 3, can provide feedback to onboard controller 120, which regulates the volume of air admitted to the float to ensure buoy 100 does not exceed the target depth.

To ascend, the onboard controller 120 reverses the process. The air compressor 104 pumps air from the air cylinder 106 into adjustable float 108, expanding the float's 108 volume and increasing buoyancy.

Buoyancy control system 101 can comprise alternative approaches to achieve the same function. For example, a variable-volume chamber system, such as a piston-driven or bellows-based displacement mechanism, can modify the internal volume of a sealed chamber to adjust buoyancy without relying on inflatable bladders or adjustable float 108. A fluid-density-based system could also be employed, where buoy 100 contains a liquid whose density is altered through temperature control or phase-change materials to modify buoyancy. Another embodiment utilizes magneto-rheological or ferrofluid-based buoyancy control, wherein a magnetic field alters the effective density of a specialized fluid to adjust flotation characteristics. Furthermore, an artificial swim bladder-inspired mechanism could allow buoy 100 to shift an internal liquid volume between chambers to mimic the depth-regulating techniques of marine organisms. Each of these alternative approaches enables buoy 100 to dynamically regulate its buoyancy, ensuring its ability to remain in optimal positioning within a hurricane.

Housing 102 of buoy 100 may be constructed from heavy PVC or aluminum pipes designed to endure high winds and waves. The total weight of buoy 100 is ideally between 50 and 100 pounds for easy handling during air drops.

Through this controlled interplay of pumping air, adjusting volume of adjustable float 108 via the bidirectional valve 107, buoy 100 can actively manage its buoyancy. By ascending when the hurricane's eye is overhead and descending to avoid the strong currents or winds in the eye wall, buoy 100 remains positioned in or near the eye for extended periods, thereby enhancing the reliability and continuity of hurricane-related data collection.

FIG. 3 shows onboard controller 120 configured to operate a buoyancy control system 101 of buoy 100. Depth or pressure sensors 122 provide real-time feedback to the control controller 120, enabling precise tuning of the ascent and descent of buoy 100. Through data received from depth or pressure sensors 122, controller 120 can determine when to activate buoyancy control system 101 (including air compressor 104, air cylinder 106, and the bidirectional valve 107, e.g., to increase buoyancy (for example, by transferring air from air cylinder 106 into inflatable float 108) or when to transfer air back to air cylinder 106 for reducing buoyancy.

To collect environmental data, buoy 100 is equipped with a variety of sensing instruments. Weather instruments 124 measure parameters such as wind speed and direction, air temperature, humidity, and barometric pressure. Sea instruments 126 measure parameters such as water temperature, salinity, and current speed and other factors relevant to hurricane tracking, for example, wave height or water pH. Data from these sensors is continuously fed to the controller 120, where it can be processed, stored, or relayed in real time via a transmitter or transceiver 130 to a base station 132.

A GPS module 134 is provided for determining the precise geolocation of buoy 100. The GPS data is used by controller 120 to track the position of buoy 100 relative to the hurricane's eye and to coordinate with external systems. Additionally, transmitter or transceiver 130 is integrated into buoy 100 to wirelessly communicate data gathered by the weather instruments 124 and sea instruments 126 to remote base station 132 or satellite network. This communication link allows for real-time monitoring of the hurricane's progression, enabling more accurate tracking and forecasting.

In operation, controller 120 manages both data collection and buoyancy adjustments. For instance, when buoy 100 needs to descend to avoid high current speeds in the eye wall, controller 120 activates air compressor 104 to use bidirectional valve to deflate float 108 until the descent is complete. Conversely, to ascend, controller 120 commands air compressor 104 of buoyancy control system 101 to transfer air from air cylinder 106 into float 108. Depth or pressure sensors 122 send continuous feedback to ensure buoy 100 maintains the correct depth or returns to the surface as desired.

Ascending is automated by a signal from a solar panel 140. As previously stated, the eye of the hurricane is generally sunny. At 30 meters below the surface, the currents are relatively calm and sunlight is easily able to penetrate to this depth. When solar panels 140 detect sunlight, a signal can be sent to controller 120 to initiate the ascending algorithm previously described. By integrating these components—computer control, buoyancy regulation, environmental and weather instruments, GPS positioning, solar light detection, and wireless communications—buoy 100 is capable of autonomously gathering and transmitting high-value data on hurricane behavior from within or near the hurricane eye. This data, in turn, enables improved modeling, forecasting, and disaster preparedness throughout the hurricane's lifecycle.

In one embodiment, sea instruments 126 can be lowered beneath buoy 100 via a motorized winch 142 with cable or rope 114. A telescoping boom 116 operated by a boom actuator 144 can be used to deploy one or more weather instruments 124 upward. Onboard controller 120 can automate both processes, determining when and how to deploy or retract the respective instruments based on preprogrammed algorithms, real-time sensor data, or direct commands from a remote operator.

To deploy the sea instruments 126, onboard controller 120 activates motorized winch 142 to reel out cable or rope 114 to which sea instruments 126 are attached. As previously stated, sea instruments 126 may include sensors for measuring water temperature, salinity, dissolved oxygen, current velocity, pH, or other relevant parameters. Onboard controller 120 monitors depth or tension feedback from a winch sensor 143 to ensure sea instruments 126 are deployed to the correct depth without exceeding mechanical stress limits. Once sea instruments 126 reach the desired depth, controller 120 halts winch 142, allowing continuous data collection. Collected data is then sent back to controller 120 for processing, storage, or immediate transmission via buoy's transceiver 130.

Conversely, weather instruments 124 is attached to telescoping boom 116 mounted on the upper housing of buoy 100. Telescoping boom 116 can be pneumatically or electromechanically driven, enabling it to extend above housing 102 to measure variables such as wind speed, wind direction, atmospheric temperature, barometric pressure, and humidity. When controller 120 determines that conditions are suitable for weather data collection—e.g., when buoy 100 is floating on the surface in the hurricane eye or may otherwise need to sample environmental conditions—controller 120 sends a control signal to boom actuator 144, causing the telescoping sections of the boom 116 to extend. Once fully extended, weather instruments 124 begin transmitting data back to controller 120.

Both the motorized winch 142 and telescoping boom 116 can be commanded to retract their respective instrument arrays to protect them from damage during periods of extreme wind, waves, or when buoy 100 descends below the surface. In such cases, controller 120 reverses power to winch 110, reeling in the cable or rope 114 until the sea instruments 126 are safely stowed within or adjacent to buoy 100. Similarly, controller 120 sends a command to boom actuator 144 to collapse the telescoping sections, securing the weather instruments 124 in or against the buoy's 100 protected housing 102.

In some implementations, controller 120 may operate these deployments in a fully autonomous manner based on sensor thresholds. For example, if the wave height sensor detects dangerously large swells, or if wind sensors indicate excessively high wind speeds, controller 120 automatically retracts telescoping boom 116 and winch 110 to safeguard the respective weather instruments 124 and sea instruments 126. During calmer periods, controller 120 may extend them to collect critical data. This adaptive deployment strategy ensures that weather instruments 124 and sea instruments 126 remain operational while minimizing the risk of damage, thereby extending their functional lifespan.

Once data is collected from the weather instruments 124 and sea instruments 126, controller 120 can process the raw sensor signals, bundle them with GPS location data, and transmit them via the buoy's 100 onboard transceiver 130 to remote base station 132 or satellite network. In this way, buoy 100 offers real-time or near-real-time monitoring of conditions above and below the water surface, facilitating more accurate analysis of hurricanes or other severe weather systems.

The electrical power required to operate buoy 100 is minimal. In one embodiment, buoy 100 includes a sealed battery pack 118 housed within a watertight compartment to supply power to all onboard systems. Battery pack 118 can be composed of one or more fixed voltage or rechargeable cells, arranged in series or parallel, and coupled to a battery management system (BMS) to monitor charge levels, voltage, temperature, and overall health of the battery pack 118 to ensure safe, reliable operation. Power is distributed through an internal wiring harness, which carries electrical current from the battery pack 118 to control controller 120, buoyancy control system 101 (including the air compressor 104, air cylinder 106, float 108, and bidirectional valve 107), motorized winch 110, telescoping boom 116, and the various sensors and instruments discussed above. In certain implementations, switches or relays under the control of controller 120 selectively enable or disable individual subsystems, thereby conserving power when certain components are not in use. For example, controller 120 may keep the motorized winch 110 de-energized until it is needed for instrument deployment. Transceiver 130 may also be placed into a low-power or standby mode between scheduled communication intervals. By dynamically managing power distribution, buoy 100 optimizes battery usage, enabling long-term operation in the field without requiring frequent battery replacement or recharging. In an embodiment, the deployed buoy 100 need only have sufficient power to last the life of a hurricane. In another embodiment, batter pack 118 is recharged via solar panels 140 to extend the useful life of buoy 100.

Although conventional means may be used to control and guide buoy 100, artificial intelligence (AI) and machine learning algorithms can make buoy 100 more effective in additional scenarios. An onboard AI model enables rapid data analysis, quick feedback, and more accurate decision-making. Hurricanes produce complex, stormy seas with many unknown factors, including scarce data on currents beneath hurricanes. Consequently, buoy 100's control strategy benefits significantly from trial-and-error experimentation. Typically, analyzing such experimental data can take weeks, but AI and machine learning algorithms accelerate this process. Data collected from experiments can be used to refine the AI model that controls buoy 100.

In such improvements, the artificial intelligence (AI) or machine learning (ML) algorithms may be loaded onto controller 120. These algorithms can be stored locally in onboard non-volatile memory (e.g., solid-state drive or flash memory) or received from a remote server via the transceiver 130 and then cached for offline execution. By continuous training through continuous analysis of operational data-such as depth/pressure readings, battery levels, sensor feedback, and environmental conditions—the AI/ML models learn patterns and make predictive adjustments to conserve power and enhance performance. For instance, if the AI model detects that rapid changes in wind velocity typically occur during certain phases of a hurricane, it may autonomously decide to retract the motorized winch 110 or telescoping boom 116 during these periods to reduce drag and power consumption. Conversely, when calmer conditions are detected or predicted, the AI may proactively deploy sensors for more comprehensive data collection.

In addition, AI/ML can optimize communication intervals to minimize energy usage of transceiver 130. By analyzing both historical and real-time meteorological data, the onboard AI might infer when critical data points (e.g., near the eye of the hurricane) are most likely to yield important insights for hurricane tracking. It can then schedule more frequent transmissions during those periods and reduce transmission frequency when data is less urgent. Furthermore, the AI can dynamically balance the power demands of various subsystems—for example, temporarily disabling the air compressor or limiting usage of onboard lighting if sensor data indicates an impending need for increased communication bandwidth or extended motorized winch activity.

Another advantage of employing AI/ML is the system's ability to adapt to unforeseen conditions and continuously improve its decision-making processes through ongoing training. Initial AI/ML models may be developed and tested using historical hurricane data. Once deployed, real-time sensor readings can be fed back into the models for continuous training, allowing them to refine future predictions and responses. Over time, buoy 100 becomes more adept at identifying patterns and anomalies in oceanic currents, wind shear, or temperature gradients, thereby enhancing its navigational strategy (e.g., timing descents or ascents to remain optimally positioned in or near the hurricane eye). This iterative, data-driven approach not only improves the accuracy of measurements but also prolongs buoy life by judiciously allocating power resources based on empirically learned behaviors.

By integrating AI/ML algorithms with the controller's 120 existing power management logic, buoy 100 achieves an advanced level of autonomy, dynamically responding to environmental cues without requiring constant human oversight. The result is a robust, intelligent control system that maximizes both data quality and operational longevity, making the buoy particularly suited for long-duration hurricane monitoring and other demanding oceanographic research endeavors.

Controller 120 can be implemented in a conventional computing platform for executing the processing functions necessary to navigate buoy 100 and carry out its mission described herein. In one implementation, a controller 120 comprises a system including central processing unit (CPU) 150, a system memory 152, transceiver 130 and one or more software applications and drivers enabling or implementing the methods and functions described herein. Hardware system includes a standard I/O bus 154 with I/O Ports 156 and mass storage 158 (which can also be a non-volatile Flash Memory) coupled thereto. Bridge 160 couples CPU 150 to I/O bus 154. These elements are intended to represent a broad category of computer hardware systems, including but not limited to general-purpose computer systems based on the Pentium processor manufactured by Intel Corporation of Santa Clara, Calif., as well as any other suitable processor.

Elements of the controller 120 performs their conventional functions known in the art. In particular, transceiver 130 is used to provide communication between CPU 150 and base station 132. Mass storage 158 can be provided and used to provide permanent storage for the data and programming instructions to perform the above-described functions implementing the test to be carried, whereas system memory 152 (e.g., DRAM) is used to provide temporary storage for the data and programming instructions when executed by CPU 150. I/O ports 156 are one or more serial and/or parallel communication ports used to provide communication between additional peripheral devices, such as weather instruments 124, sea instruments 126, buoyancy control system 101, depth or pressure sensors 122, GPS 134, winch 142 and boom actuator 144, etc.

Controller 120 may include a variety of system architectures, and various components of CPU 150 may be rearranged. For example, cache 162 may be on-chip with CPU 150. Alternatively, cache 162 and CPU 150 may be packed together as a "processor module," with CPU 150 being referred to as the "processor core." Furthermore, certain implementations of the claimed embodiments may not require nor include all the above components. Also, additional components may be included, such as additional processors, storage devices, or memories.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

We claim:

1. A buoy for collecting real-time atmospheric and oceanic data from a hurricane, comprising:

a housing configured to float on a water surface;

a buoyancy control system housed within the housing;

a solar sensor for detecting light;

a controller adapted for determining when the buoy is substantially near a front center of the hurricane in order to command the buoyancy control system to descend, and thereafter the controller commands the buoyancy control system to ascend when the buoy detects a return to an eye of the hurricane based on light detection from the solar sensor.

2. The buoy of claim 1, wherein the buoyancy control system further comprises:

an air compressor;

an air cylinder in fluid communication with the air compressor;

an adjustable float operatively coupled to the air cylinder, wherein the adjustable float is configured to selectively receive or release air to control buoyancy; and a bidirectional valve configured to regulate airflow between the air cylinder and the adjustable float.

3. The buoy of claim 1, and further comprising:

a GPS system for receiving GPS data for tracking a path of the buoy within an eye of the hurricane;

wherein the controller is configured to receive information about a diameter of the eye of the hurricane and a speed of the eye of the hurricane and calculate therefrom a traversal time corresponding to an amount of time to traverse from a back (B) of the eye of the hurricane to a front (F) of the eye of the hurricane, and to command the buoy to descend at the traversal time.

4. The buoy of claim 1, and further comprising:

a wind direction sensor configured to detect a change in wind direction;

wherein the controller is in communication with the wind direction sensor to determine whether a significant change in wind direction has occurred based on a predefined threshold that indicates that the buoy is substantially near the front center of the hurricane, and wherein the significant change in wind speed is one chosen from: (i) when the wind direction deviates from an expected rotational path of the hurricane eye within a period of time; (ii) when the wind direction shifts outward relative to a center of hurricane within a period of time; (iii) when a wind direction rate of change exceeds an angular change per unit of time; or (iv) when outward drift speed of buoy 100 exceeds 0.5-2 knots, inclusive (or any speed in between) with a wind speed exceeding 10-50 knots, inclusive (or any speed in between) and wind direction changes 1° to 30°, inclusive (or any angle in between) within a period of 1 second to 60 seconds, inclusive (or any number of seconds in between).

5. The buoy of claim 1, wherein the buoyancy control system is configured to descend the buoy to a depth where ocean currents are at least fifty percent less than surface currents upon detecting a significant change in wind direction.

6. The buoy of claim 1, wherein the buoyancy control system is configured to descend the buoy to a depth where ocean currents are at least eighty percent less than surface currents upon detecting a significant change in wind direction.

7. The buoy of claim 6, wherein the controller triggers the buoyancy control system to ascend when the solar sensor detects sunlight.

8. The buoy of claim 3, wherein the buoyancy control system is configured to descend the buoy to a depth where ocean currents are substantially less than surface currents upon detecting the front of the eye of the hurricane and a significant change in wind direction, and wherein the buoyancy control system is configured to ascend when the solar sensor detects sunlight.

9. The buoy of claim 3, wherein the controller further comprises a memory for storing instructions executable by the controller to: determine whether the front of the eye of the hurricane has been reached based on the GPS data and a significant change in wind direction has occurred based on a predefined threshold; command the buoyancy control system to descend when the front of the eye of the hurricane is reached based on the GPS data and the significant change in wind direction is detected; and command the buoyancy control system to ascend when the controller detects a return to the hurricane eye, based on light detection and wind direction stabilization.

10. The buoy of claim 9, and further comprising:

a motorized winch configured to deploy a sea instruments;

an extendable boom configured to deploy weather instruments;

a battery controller configured to enter a low-power mode when environmental conditions indicate minimal expected change in a path of the hurricane; and a transmitter in communication with the controller configured to communicate to a base station data collected from the sea instruments and the weather instruments.

11. A buoy for collecting real-time atmospheric and oceanic data from a hurricane, comprising:

a housing configured to float on a water surface;

a means for buoyancy control housed within the housing;

a wind direction sensor configured to detect a change in wind direction;

a controller in communication with the wind direction sensor, a GPS sensor and the means for buoyancy control to determine whether a front of an eye of the hurricane has been reached based on information about a diameter and speed of the eye of the hurricane, and GPS data a significant change in wind direction has occurred based on a predefined threshold, command the means for buoyancy control to descend when the significant change in wind direction is detected, and to command the means for buoyancy control to ascend when the controller detects a return to an eye of the hurricane, based on light detection.

12. A method for maintaining a position of a buoy within or near an eye of a hurricane, comprising:

deploying a buoy into the eye of a hurricane;

using hurricane location, eyewall diameter, wind speed and current speed data from a hurricane tracking source;

calculation of path around the eye of the hurricane using GPS data;

detecting a significant change in wind direction relative to an expected rotational path of the hurricane;

determining whether the buoy is drifting outward from an eye of the hurricane;

activating a buoyancy control system to descend the buoy to a depth where ocean currents are reduced, upon detecting the significant change in wind direction;

monitoring ambient light levels using a solar sensor to detect when the buoy has re-entered the eye; and activating the buoyancy control system to ascend the buoy to the surface upon detecting sunlight.

13. The method of claim 12, wherein the step of activating a buoyancy control system to descend further comprises:

operating an air compressor to transfer air between an air cylinder and an adjustable float;

opening a bidirectional valve to allow airflow between the air cylinder and the adjustable float;

return air from the adjustable float into the air cylinder; and reducing a volume of the adjustable float, increasing a density of buoy and causing buoy to descend.

14. The method of claim 12, wherein the step of activating a buoyancy control system to ascend further comprises:

operating an air compressor to transfer air between an air cylinder and an adjustable float;

opening a bidirectional valve to allow airflow between the air cylinder and the adjustable float; and expanding a volume of the adjustable float while maintaining a constant mass, thereby reducing a density of buoy and causing buoy to ascend.

15. The method of claim 12, and further comprising:

confirming when the buoy is at the front (F) of the hurricane by comparing a wind direction at F with a wind direction as a back (B) of the eye of hurricane, wherein the wind direction a F is opposite the wind direction at B.

16. The method of claim 12, and further comprising descending the buoy to a depth where ocean currents are at least fifty percent less than surface currents upon detecting a significant change in wind direction.

17. The method of claim 12, and further comprising descending the buoy to a depth where ocean currents are at least eighty percent less than surface currents upon detecting a significant change in wind direction.

18. The method of claim 12, and further comprising triggering the buoyancy control system to ascend when the solar sensor detects sunlight.

19. The method of claim 12, and further comprising descending the buoy to a depth where ocean currents are substantially less than surface currents upon detecting a significant change in wind direction, and ascending when the solar sensor detects sunlight.

20. The method of claim 12, and further comprising:

determining from the GPS data and a significant change in wind direction that the buoy should descend; and commanding the buoyancy control system to ascend when the buoy detects a return to the eye, based on light detection and wind direction stabilization.

* * * * *